United States Patent [19]

Abell, Jr.

[11] 4,022,312

[45] May 10, 1977

[54] SEMI-AUTOMATIC CENTERING CONTROL

[75] Inventor: William Albertus Abell, Jr., Lexington, Ky.

[73] Assignee: International Business Machines Corporation, Armonk, N.Y.

[22] Filed: Dec. 24, 1975

[21] Appl. No.: 644,255

[52] U.S. Cl. ..... 197/15; 197/91

[51] Int. Cl.[2] ..... B41J 23/20; B41J 19/62

[58] Field of Search ..... 197/15, 18–20, 197/84 A, 84 R, 91, 113, 187; 137/624.13, 624.16, 624.17

[56] References Cited

UNITED STATES PATENTS

| | | | |
|---|---|---|---|
| 1,455,079 | 5/1923 | Cook | 197/91 |
| 2,606,739 | 8/1952 | Gardner | 137/624.13 X |
| 3,382,963 | 5/1968 | Cralle | 197/84 A X |
| 3,618,736 | 11/1971 | Abell et al. | 197/91 X |
| 3,625,335 | 12/1971 | Ricciardi et al. | 197/91 X |
| 3,892,304 | 7/1975 | Shakib | 197/18 |
| 3,924,723 | 12/1975 | Cooper et al. | 197/84 A X |

OTHER PUBLICATIONS

IBM Technical Disclosure Bulletin, W. H. Castle et al., vol. 15, No. 3, Aug. 1972, pp. 978–979.

*Primary Examiner*—Edgar S. Burr
*Assistant Examiner*—Paul T. Sewell
*Attorney, Agent, or Firm*—Laurence R. Letson

[57] ABSTRACT

Disclosed is a control mechanism and device for conditioning a typewriter to backspace on every other depression of a keylever and at the same time to prevent printing on all depressions of keylevers. Additionally, the typewriter is conditioned to not print on those cycles in which a backspace movement is not included.

This control mechanism and system allows the typist to key headings and other materials which would normally be centered in a no print mode and upon the completion of keying the entry once and switching into a normal typing mode, the typewriter is properly positioned with respect to the page for immediate rekeying of the heading or entry to provide centered copy.

2 Claims, 3 Drawing Figures

FIG. 2
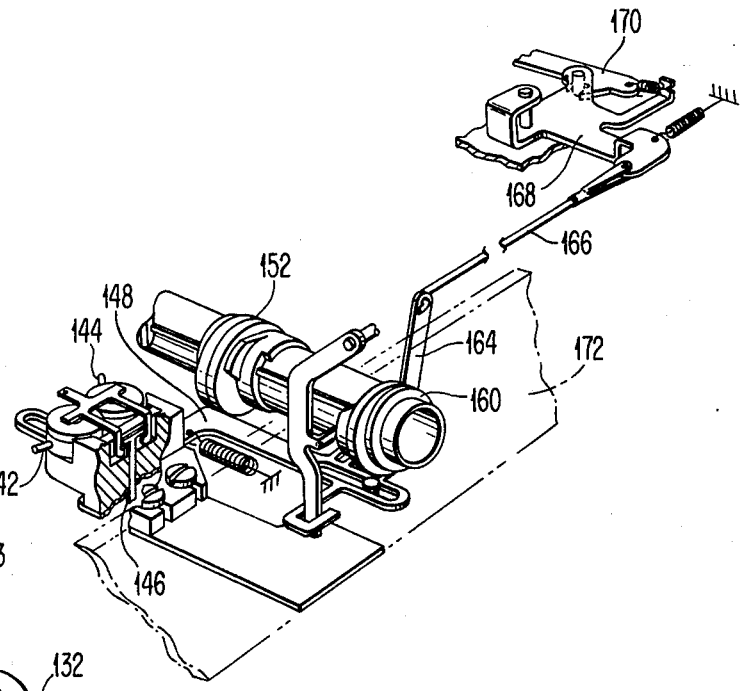
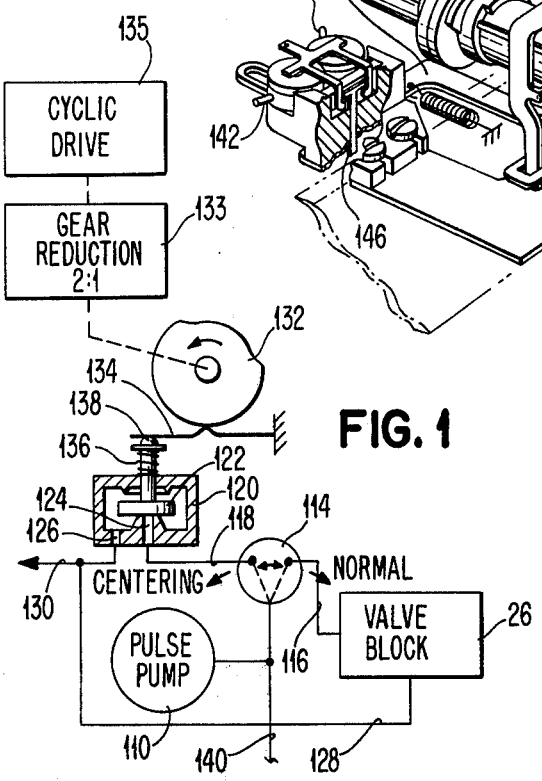
FIG. 1
FIG. 3
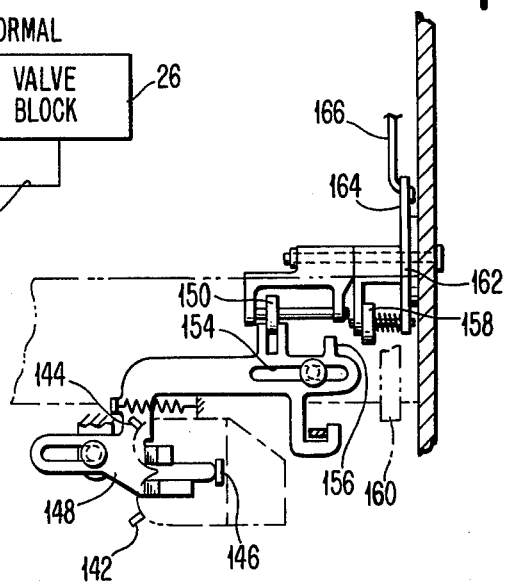

SEMI-AUTOMATIC CENTERING CONTROL

RELATED IBM PATENT APPLICATIONS

Reference is made to U.S. Pat. No. 3,892,304, issued to I. D. Shakib which discloses a typewriter having the selection function self-contained within the printing carrier and is illustrated using pneumatic controls. This patent is incorporated by reference for purposes of disclosure into this application.

BACKGROUND OF THE INVENTION

Heretofore, the typist when desiring to center a heading or title, had several alternative techniques at her disposal. The first is one where the typewriter is positioned such that the printing point is at the left margin. Upon this positioning of the typewriter, if the typewriter had a no print feature the no print control is activated and the heading or title to be centered was then keyed. This caused the typewriter to escape in its normal mode and at the same time prevented marks from being placed upon the copy sheet. At the completion of the keying, the typist then determined the distance that the print point had traversed from the left margin in character spaces and divided by two. This number was then substracted from the relative position number designating the center of the page or the center point around which the heading was to be positioned. This gave a relative position to which the print point of the typewriter was manually adjusted. The typewriter was then enabled for printing and the entry typed in a normal manner.

A second technique was to place the print point of the typewriter at the center line point and then mentally group letters in the heading which is to be typed in pairs. As each pair was grouped and thought of, the backspace control for the typewriter was depressed once.

Upon the completion of the metal grouping of all characters into pairs and the appropriate number of depressions of the backspace mechanism, the print point was properly positioned for typing. This technique is most predominantly used on those typewriters without a no print capability.

A third approach was to count the letters and spaces in the heading or entry, divide by two, and substract the result from the center point position, yielding a relative position for the beginning of the title or entry.

As can be seen from the foregoing, all required concentration on the part of the typist.

Also, all required some type of manipulation which was relatively abnormal with respect to the normal typing function.

OBJECTS OF THE INVENTION

It is an object of this invention to position a typing point relative to a copy page on a typewriter such that a subsequently typed entry will be centered about a desired point, while using normal typing procedure and keying.

It is a further object of this invention to eliminate abnormal procedures and processes in the positioning of a typewriter such that a centered entry or heading may be typed.

Other objects and advantages will become apparent from a more thorough understanding of the following specification.

SUMMARY OF THE INVENTION

The proper positioning of the print point of a typewriter may be accomplished by moving the print point of the typewriter to the centering point or centering location about which a heading or title is to be subsequently printed and centered. Then a control member which is on the keyboard of the typewriter may be activated to prevent normal typing signals from being transmitted from the keyboard to the printing mechanism and at the same time in response to the activation of the control on the keyboard changing each depression of a letter or space key into a command which is interpreted as a backspace code. A further bicyclical control allows the backspace code to be transmitted to the backspace mechanism on every other cycle and intercept and prevents the backspace code from being transmitted on the alternate cycles thus allowing the typewriter to respond in a backspace condition on one half of the keystrokes and to not print and not escape during the remaining half of the keystrokes.

DRAWINGS

FIG. 1 illustrates a schematic diagram of a system which is particularly adapted to providing a semi-automatic capability for positioning the typing mechanism of a typewriter with respect to a copy sheet for the subsequent and immediate rekeying of an entry to provide the entry typed and centered about a point.

FIGS. 2 and 3 illustrates an alternative control mechanism to that disclosed in FIG. 7 of U.S. Pat. No. 3,892,304 which controls a velocity no print and backspace.

DETAILED DESCRIPTION OF THE INVENTION

The detail description of the invention will be made based upon a typewriter of the type disclosed in U.S. Pat. No. 3,892,304 to I. D. Shakib, but it should be understood that the concept and controls could be changed from a pneumatic control system to an electronic or mechanical control system using the appropriate equivalent such as transistor logic and switches or latches and mechanisms. Numerous references will be made to U.S. Pat. No. 3,892,304 during the course of this disclosure.

FIG. 20 of the Shakib patent, illustrates a schematic of the pneumatic controls for the keyboard 18 of the type of typewriter mechanism involved herein. As can be seen from the drawing in the Shakib patent, a keyboard signal generator 26 provides signals to a logic block 28. The number of signals N designated by the lines 20 as an arbitrary number of input signals. These signals are decoded, combined, and logically utilized to provide an increased number of output signals M. The specific design of the logic block 28 is immaterial inasmuch as the same results may be accomplished by any one of a number of conventional logic decoding designs and structures. Further, the designation of the particular signals outputting from the logic block is arbitrary and may be designated in any manner. In this disclosure, the name of the function to be controlled will be used to designate the signals as opposed to any arbitrary code or abbreviations.

One illustration of signals which may emanate from the logic block 28 in addition to those illustrated in FIg. 20 of the Shakib patent (dead key, no print, rack switch) also include a low velocity signal. One example of the way the logic system can be used is to set up the typewriter such that in the event no signals are received to the input side of the logic block 28 of FIG. 20 of the Shakib patent, then the output from that logic block 28 will be dead key operation or no escape operation and a no print because the outputs for selection do not exist and the pressure pulse on line 40 will result in a pulse to the no escape actuator 318 and the no print actuator 270 as illustrated in Shakib or actuator 144 in this description. The logic block 28 can also be set up such that if a particular unique signal is the only signal received from the keyboard signal generator 26, then the output of the logic block 28 is the same as if it had received no signals, with one additional exception and that being that the low velocity output is provided as a third logic block output. For purposes of this disclosure, the entire coding nature of the logic block 28 is immaterial inasmuch as it does not constitute part of the subject invention. The only relevant signals which need to be considered which may be derived in any desired manner are the dead key, no print, and low velocity signals. It should be realized that these are signals which may be totally unique or may be derived from a combination of other inputs and outputs of the logic block and may be electrical, mechanical, or pneumatic in nature. Additionally, it should be recognized that each may be a completely dedicated input and output signal directly from the keyboard signal generator or may be derived from the logic block.

With the understanding that the typewriter will function in a no print no escape operation if the logic block 28 receives no keyboard input signals it is thus necessary to isolate valves in the keyboard signal generator 26 from the logic block 28. This may be accomplished by inserting a control valve or selector valve into the pneumatic system to prevent the pressure pulse from pulse pump 110 from reaching the valve block 26. Valve block 26 is the equivalent of keyboard signal generator 26 of Shakib and thus similarly numbered. Selector valve 114 is the type of valve which causes a diversion of the pulse from the pump 110 from one outlet line 116 to a second outlet line 118. By interrupting the pressure line 116 and preventing it from being pressurized, valve block 26 is effectively isolated and eliminated from the network when the selector valve 114 is in "centering mode". At that point, pressure line 118 receives the output of pulse pump 110. This pressure line is connected to provide pressure to a control valve 120. Control valve 120 is configured such that piston 122 will seal the input port 124 when in its down position. Outlet port 126 is connected to a pressure line which will lead any pressure pulse in the chamber of valve 120 to the logic block 28. This output signal will result in a low velocity signal. Pressure line 128 from valve block 26 is Tee-ed into the line 130 coming from outlet 126. Thus the valve block 26 during normal operation is also capable of providing a signal on output line 130 through line 128 to the logic block 28 resulting in a low velocity control signal. A two cycle cam 132 is mounted such that it may be driven through the appropriate gear ratios 133 from any cyclic member 135 of the typewriter such as the print shaft or other appropriate drive member. The gear ratio, for example being 2:1, provides a revolution of the bicyclic cycle cam 132 over a period of two cycles of the typewriter. The high dwell of the cam is presented to follower 134 during one cycle and a low dwell presented during the second cycle. Follower 134 is illustrated as a flexible leaf spring, however, it may be any suitable cam follower mechanism. Valve 120 is also illustrated having a coil compression spring 136 around the valve stem 138. This allows the coil spring to open the valve when a low dwell of the cam 132 is presented to cam follower 134.

With the understanding that the typewriter will operate in a zero rotate zero tilt mode and the no print mode whenever signals from the valve block 26 are not received at the logic block, and where a low velocity signal combined with the no print signal which is created by a lack of output pulses from the valve block will yield a backspace, it is seen in those cycles where there are no pressure signals sent by the valve block 26 a no print and non-escape will occur. Thus, by controlling the low velocity signal on every other cycle, and isolating the valve block 26 to prevent it from generating signals at the keyboard, the machine can be caused to backspace on cycles where the low velocity signal is transmitted from the logic block and caused to not print and not escape on those cycles when the low velocity signal is not transmitted. Thus when the typist desires to enter a "centering" mode, selector valve 114 is shifted to the "centering" position. This prevents pressure pulses from pulse pump 110 from reaching valve block 26 and thus prevents outputs from the valve block 26. The rerouting of the pressure pulses by selector valve 114 to line 118 provides the pressurized pneumatic source to valve 120. As each cycle of the typewriter is initiated, the two cycle cam 132 will rotate one half revolution in response to the cyclic operation of the typewriter. Thus on every other cycle of the typewriter, valve 120 will be actuated or opened as a result of the low dwell on cam 132 allowing follower 134 to flex and thus relieve the closing force on valve pin 138. Coil spring 136 will cause piston 122 to move upward thus completing the path between line 118 and output line 130. Thus a pulse signal appears on output line 130 to the logic block on every other cycle. Output line 130 is arbitrarily designated as the low velocity line. To provide low velocity control during the "normal" mode of operation valve block 26 also provides a low velocity line 128 which is Tee-ed into line 130. Thus when a low velocity character is keyed at the keyboard, the signal is transmitted to the logic indicating low velocity. However, at that time other signals will be emanating from the valve block 26 which will cause the machine to operate in its normal manner.

The logic block 28 is also provided with a pulsed output from the pulse pump on line 140. This provides the pneumatic pulse or power to result in a signal from the logic block 28 to cause the typewriter to operate in the no print and non-escape mode when no signals are received from the valve block 26. The device for addition of the no print signal and the low velocity signal to cause a backspace is illustrated in FIGS. 2 and 3. When a pulse is received on both lines 142, 144 simultaneously, the rocker stop finger 146 of the pneumatic AND mechanism is caused to rise thus allowing slider 148 to translate to the right shifting print cam follower roller 150 off the profiles of the print cam 152. The print cam follower shifter 154 also has a member 156 which forces the backspace cam follower roller 158 under the profile of the backspace cam 160. As the backspace cam rise forces the backspace cam follower 162 downward, the cam follower pivots and through a bell crank arm 164 pulls on line 166 which in turn causes a backspace bell crank 168 to pivot clockwise and thus pull the backspace pawl 170 to the right. This causes the movement of the carrier 172 to the left relative to a fixed backspace rack.

Thus when the typewriter is positioned at a point around which an entry is to be centered, and the selector valve 114 is changed to "centering" mode, the depression of keylevers of the typewriter will cause the carrier to backspace on alternate keylever strokes and upon the completion of the keying and resetting of the selector valve 114, the typewriter will be ready for typing the entry, centered about the desired point.

This disclosure has been made using a pneumatic system for sake of illustration. One skilled in the art will recognize that electrical and mechanical equivalents are easily substituted to accomplish the same function. Transistor logic and electrical switches can be controlled to provide the desired signals while mechanical latches and actions can also be used to control the typewriter mechanisms.

I claim:

1. A semi-automatic bicyclic backspace control for use on a cyclic typewriter comprising in combination, selection means for selecting the mode of operation, said modes of operation being normal printing mode and a positioning mode;

a pressure source for providing pneumatic pulses to said selection means;

and plurality of valves connected to said selector means and supplied pressurized pulses therefrom;

a separate valve with the inlet of said separate valve connected to said selection means;

said connection between said separate valve and said selection means being such that pressurized pulses may flow from said selection means through said separate valve when said selection means is in said positioning mode;

an outlet pressure line emanating from said separate valve;

a cam;

follower means engaging said cam and acting to control said separate valve in response to a rise of said cam, means driving said cam in response to the cyclical operation of said typewriter and at a rate to present a rise of said cam to said follower every alternate cycle of said typewriter, whereby pulses from said pump are only capable of being transmitted to a utilizing device in the positioning mode every other cycle of said typewriter operation.

2. A typewriter, comprising printing means, character key levers to control said printing means, escapement means, backspace operating means, control means for causing operation of said backspace operating means in response to character keylever depressions from the keyboard of said typewriter, and means for preventing said control means from operating said backspace means in response to normal character keylever depressions of said keyboard on alternate cycles of said typewriter;

means for preventing said printing and escapement means from printing and escaping in response to characeter keylever depressions, said means for preventing printing and escaping and said means for controlling said backspace mechanism being responsive to said control means connected operatively thereto, whereby said typewriter is backspaced on alternate cycles while being operated in a non-printing and non-escaping operation on the remaining cycles of said typwriter operation in response to keylever depressions, thereby causing said typewriter to reverse escape one half of the length of an entry allowing improved operation prior to printing an entry centered around a starting point.

* * * * *